US007560398B2

(12) United States Patent
Zillig et al.

(10) Patent No.: US 7,560,398 B2
(45) Date of Patent: Jul. 14, 2009

(54) CLEANING WIPE AND METHOD OF MANUFACTURE

(75) Inventors: Daniel J. Zillig, Cottage Grove, MN (US); Gary L. Olson, Shoreview, MN (US); Thomas E. Haskett, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 457 days.

(21) Appl. No.: 10/622,973

(22) Filed: Jul. 18, 2003

(65) Prior Publication Data

US 2005/0014434 A1 Jan. 20, 2005

(51) Int. Cl.
*B32B 3/00* (2006.01)
*B32B 3/02* (2006.01)

(52) U.S. Cl. ..... 442/61; 442/59; 428/364; 428/375; 428/396

(58) Field of Classification Search ..... 428/343, 428/354, 364, 375, 396; 442/59, 61, 149, 442/151, 164, 170, 171
See application file for complete search history.

(56) References Cited

U.S. PATENT DOCUMENTS 5,198,292 A * 3/1993 Lerner et al. ..... 442/97
2002/0042962 A1 4/2002 Willman et al.
2002/0050016 A1 5/2002 Willman et al.
2004/0074520 A1 * 4/2004 Truong et al. ..... 134/6

FOREIGN PATENT DOCUMENTS

| | | | |
|---|---|---|---|
| EP | 0822 093 | * | 2/1998 |
| EP | 0822093 | A2 * | 2/1998 |
| EP | 0 829 222 | * | 3/1998 |
| EP | 0822093 | | 4/1998 |
| EP | 1 238 621 | * | 9/2002 |
| JP | 9224895 | | 9/2007 |
| WO | WO 0180705 | | 11/2001 |
| WO | WO 0180705 | A2 * | 11/2001 |
| WO | WO 03075735 | | 9/2003 |

* cited by examiner

*Primary Examiner*—D. Lawrence Tarazano
*Assistant Examiner*—Matthew D Matzek
(74) *Attorney, Agent, or Firm*—Jeffrey M. Olofson

(57) ABSTRACT

A cleaning wipe including a fiber web and a tacky material. The fiber web defines opposing surfaces and an intermediate region between the opposing surfaces. In this regard, at least one of the opposing surfaces serves as a working surface for the cleaning wipe. The tacky material is applied to the web such that a level of tacky material is greater in the intermediate region than at the working surface. In one embodiment, the amount of tacky material per area of web material is greater in the intermediate region than at either of the opposing surfaces. In another embodiment, the fiber web is a non-woven fiber web.

4 Claims, 8 Drawing Sheets

CLEANING WIPE AND METHOD OF MANUFACTURE

FIELD OF THE INVENTION

The present invention relates to a fiber web-based wiping construction. More particularly, it relates to fiber web material cleaning wipe constructions incorporating a tacky material and exhibiting a minimal surface drag characteristic.

BACKGROUND OF THE INVENTION

Cleaning wiping products (or wipes or sheets) in various forms have long been used to clean debris from surfaces in residential and commercial environments. Most available cleaning wipe products have the same basic form, including a relatively thin base comprised of a fibrous material (or web) that is at least somewhat supple to enhance user handling. To this end, a number of different materials and manufacturing techniques have been developed (e.g., woven, nonwoven, or knitted base structure comprised of natural and/or synthetic fibers), each having certain characteristics adapted to at least partially satisfy a particular end use. In addition, efforts have been made to incorporate certain additives into the fiber web to better address the needs of specific applications.

For example, residential or household consumers commonly use cleaning wipes or cloths to remove debris from various surfaces around the home. A so-called "dust cloth" is an exemplary item used for these applications. While these and similar cloth materials are quite useful for removing dust and other minute particles from surfaces, they cannot readily remove larger and/or heavier debris (e.g., sand, food crumbs, etc.) because these particles will not adhere to, or be retained by, the cloth. Though not necessarily developed to address this problem, common cloth treatment materials, such as wax or oil, may enhance the ability of the cloth to retain some larger debris particles due to an inherent "wetness" of the additive. Treated dust cloths leave a residue on the contacted surface that, while desirable for certain uses (e.g., furniture polishing), is unwanted for most household cleaning activities (e.g., cleaning a counter or floor surface). Further, when used for general cleaning purposes, treated cloths quickly become saturated with particles at their outer surface, thereby limiting use to short cleaning operations and requiring frequent cleaning of the wipe itself (i.e., removing accumulated particles).

Other wipe products marketed for household cleaning are adapted to include an electrostatic characteristic that, in theory, attracts debris particles to the otherwise "dry" wipe. Again, however, these dry wipes are often unable to consistently retain relatively large and/or heavy particles over extended periods of use. That is to say, relatively large and/or relatively heavy particles do not readily adhere to the dry, electrostatic-type wipes and other dry wipes. Further, the surface of these products quickly becomes "clogged" with particles, such that the collected debris must be repeatedly removed from the wipe's surface.

Of course, removing debris from surfaces is not limited to household cleaning applications. Many industrial applications entail the use of a cleaning wipe. For example, the vehicle painting/repainting industry and wood finishing industry commonly make use of "tack cloths" to remove debris from surfaces that are to be painted or stained. Generally, tack wipes or tack cloths comprise some form of textile material that has an open structure and is treated with a pressure sensitive adhesive or some other tacky polymer to give the tack cloth a sticky or tacky characteristic. When such a wipe is rubbed over a surface, foreign matter which is present on the surface will adhere to the wipe and be removed. While useful for these industrial applications, available tack wipes purposefully contain relatively high levels of the tacky material to ensure complete removal of dust and other fine particles. Known tack wipe manufacturing techniques purposefully coat the tacky material at the outer surfaces of the wipe. This coating, in turn, imparts an adhesive or sticky "feel" to the wipe, and creates significant drag as the tack wipe is moved along the surface being cleaned. Although such tack wipes have been used in the automotive painting/repainting and wood finishing industries, the negative attributes of available tack wipes have hindered their viability for certain commercial or residential uses (e.g., household or general industrial cleaning).

By way of reference, typical pressure sensitive adhesives (PSA) used to impart the tacky characteristic to a tack cloth are 100% solids hot melt PSA, radiation curable PSA, PSA dissolved in organic solvent, and latex-based PSA. Regardless, once the base web construction of the tack cloth has been formed, the PSA (or other tacky additive) is then applied. Known techniques include spraying, dip coating, roll coating, etc. In more general terms, the PSA (or other tacky material) is applied to the outer surfaces of the web; in most instances, an entire thickness of the web material is saturated with the PSA. In any event, the outer surfaces of the resultant tack cloth contain the highest concentration of the PSA, leading to the problems of drag described above.

Some efforts have been made to alter the above-described tack cloth construction to provide a cleaning wipe having a tacky characteristic with lessened adhesive "feel" and surface drag. Such efforts have generally focused on the careful selection of the type and amount of the additive material, and/or the pattern of application of the adhesive as a means for reducing drag so as to improve particle pick-up while maintaining the ability of the cleaning sheet to glide across the surface being cleaned. For example, in some approaches, relatively small levels (no more than 10 $g/m^2$, more preferably no greater than 2 $g/m^2$) of a polymeric additive, usually a pressure sensitive adhesive, is applied at discrete zones along the cleaning wipe surface. In such constructions, if the polymeric additive level is too high, the cleaning sheet will not glide easily across the surface being cleaned and/or may tend to leave residue on the surface. Though the polymeric additives and patterns used in such wipes are different from typical tack cloth configurations, the conventional technique of applying the polymeric additive to the outer surfaces of the base web is still followed. As a result, even though the reduction in adhesive level and zoned distribution may improve handling, the same issues described above will likely remain and others may be raised. That is to say, the zones at which the polymeric additive is applied may still "feel" sticky, and may create an unacceptable level of drag when the cleaning wipe is moved along a surface. Further, by reducing the level and location (i.e., provided along less than an entirety of the cleaning wipe outer surface) of the polymeric additive, the resultant cleaning wipe may be less capable of retaining sufficient amounts of particles. Also, because the polymeric additive is applied to the surface of the base web, even where the web has a relatively open construction, the cleaning wipe surface will again become clogged with particles relatively quickly.

Cleaning wipes continue to be highly popular. The ability to collect large amounts of relatively sizable and/or heavy particles has not yet been fully satisfied with a product acceptable to most users. Therefore, a need exists for a cleaning wipe having tacky attribute with minimal tackiness along the working surface thereof, along with a method of manufacturing such a cleaning wipe.

SUMMARY OF THE INVENTION

One aspect of the present invention relates to a cleaning wipe including a fiber web and a tacky material. The fiber web defines opposing surfaces and an intermediate region between the opposing surfaces. In this regard, at least one of the opposing surfaces serves as a working surface of the cleaning wipe. The tacky material is applied to the fiber web such that a level of tacky material is greater in the intermediate region than at the working surface. In one embodiment, the level of tacky material is greater in the intermediate region than at either of the opposing surfaces. In another embodiment, the tacky material includes a pressure sensitive adhesive. In another embodiment, the fiber web is a nonwoven fiber web.

Another aspect of the present invention relates to a cleaning wipe comprising a fiber web and a tacky material. The fiber web is defined by opposing surfaces, at least one of which serves as a working surface for the cleaning wipe. The tacky material is impregnated into the fiber web at a level of not less than 10 g/m$^2$. With this construction in mind, the working surface is characterized by a Drag Value of not more than 5 pounds.

Yet another aspect of the present invention relates to a method of making a cleaning wipe. The method includes providing a web construction including first and second fiber web layers and a layer of tacky material disposed between and bonding the first and second fiber web layers. As such, the web construction defines opposing surfaces and an intermediate region positioned therebetween. The web construction is transversely compressed such that the tacky material flows from the intermediate region toward the opposing surfaces. Following compression of the web construction, a level of tacky material is greater in the intermediate region than at either of the opposing surfaces. In one embodiment, the tacky material is a hot melt pressure sensitive adhesive, and the web construction is subjected to heat to soften the pressure sensitive adhesive during the step of compressing the web construction.

DETAILED DESCRIPTION OF THE PREFERRED EMBODIMENTS

Figure 1:
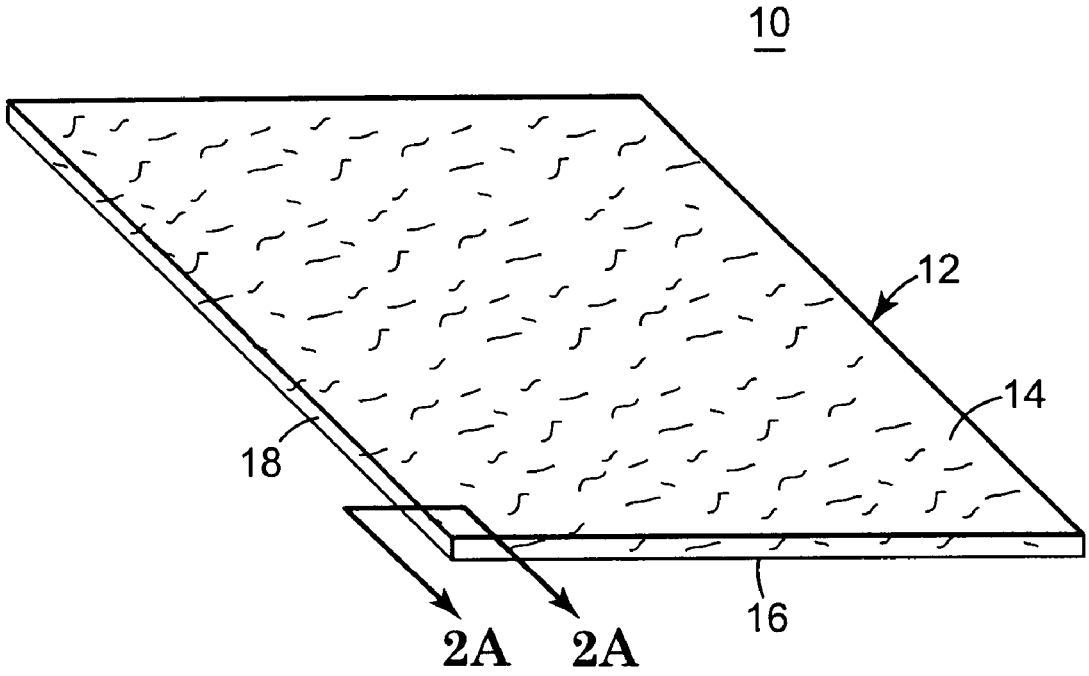
FIG. 1 is a schematic, perspective view of a cleaning wipe in accordance with the present invention.

One embodiment of a cleaning wipe 10 in accordance with the present invention is provided in FIG. 1. In general terms, the cleaning wipe 10 includes a fiber web 12 and a tacky material (unnumbered in FIG. 1). The fiber web 12 and the tacky material are described in greater detail below. In general terms, however, the fiber web 12 defines opposing outer surfaces 14, 16 (with the outer surface 16 being generally hidden in the view of FIG. 1). An intermediate region 18 (referenced generally in FIG. 1) is defined between the outer surfaces 14, 16. With these designations in mind, the tacky material coats individual fibers comprising the fiber web 12, providing a tackiness to the cleaning wipe 10. In this regard, the tacky material coating level is greater at the intermediate area 18 than at one or both of the outer surfaces 14, 16. For ease of illustration, the outer surfaces 14, 16 are shown in FIG. 1 as being substantially flat; it will be recognized that this representation does not reflect a void volume provided in embodiments of the present invention. Further, while the cleaning wipe 10 is shown in FIG. 1 as assuming a substantially planar form, other shapes are acceptable. For example, the cleaning wipe 10 can be rolled or folded onto itself to form a roll.

Figure 2A:
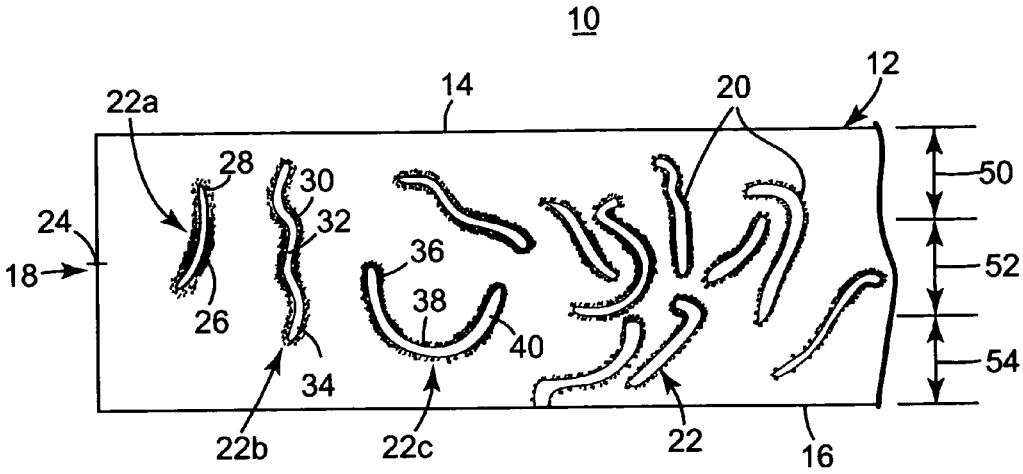
FIG. 2A is an enlarged, cross-sectional view of a portion of the cleaning wipe of FIG. 1 along the lines 2A-2A.

FIG. 2A schematically illustrates a greatly enlarged section of the cleaning wipe 10, including tacky material 20 coated to individual fibers 22 (referenced generally in FIG. 2A) comprising the fiber web 12. Once again, the outer surfaces 14, 16 are shown schematically in FIG. 2A as being flat; in embodiments of the present invention, the fibers 22 will be randomly distributed at varying locations relative to the corresponding outer surface 14 or 16, such that the outer surfaces 14, 16 are not limited to a substantially flat configuration, and will instead provide a distinct void volume within which debris (now shown) is collected. Further, the tacky material 20 is represented by stippling in FIG. 2A, with a thickness thereof relative to each of the fibers 22 being exaggerated for purposes of illustration. By way of further reference, the fiber web 12 shown in FIG. 2A is a nonwoven web in which the fibers 22 are entangled; however, as made clear below, this is but one acceptable form of the fiber web 12 and in other alternative embodiments the fibers may, for example, be woven. Also, while the web 12 is schematically illustrated as being a single layer that is relatively continuous across a thickness thereof, alternative constructions, such as for example two fiber web layers having differing characteristics adhered to one another to form the web 12 (described in greater detail below), are equally acceptable. Regardless, each of the fibers 22 extend in varying directions within the web 12. Relative to a center 24 of the web 12, sections of each of the fibers 22 will be closer to the center 24, whereas other sections will be closer to one of the outer surfaces 14 or 16.

To provide a better understanding of the varying orientation of the fibers 22, specific reference is made to the exemplary fibers 22*a*-22*c* that are otherwise shown in FIG. 2A as being relatively isolated for ease of explanation. With this in mind, the fiber 22*a* defines a first section 26 and a second section 28. The first section 26 is more proximate to the center 24, whereas the second section 28 is more proximate the outer surface 14. Similarly, the fiber 22*b* defines first, second, and third sections 30-34. The second section 32 is more proximate the center 24, whereas the first and third sections 30, 34 are more proximate the outer surfaces 14, 16, respectively. Finally, the fiber 22*c* defines first through third sections 36-40. Extension of the fiber 22*c* is such that the second section 38 is proximate the outer surface 16, whereas the first and third section 36, 40 are more proximate the center 24. Of course, a wide variety of other fiber orientations are also likely; further, the fibers 22 shown in FIG. 2A are illustrated as extending only in the plane of FIG. 2A. Others of the fibers 22 can extend entirely or partially into or out of the plane of FIG. 2A.

Figure 2B:
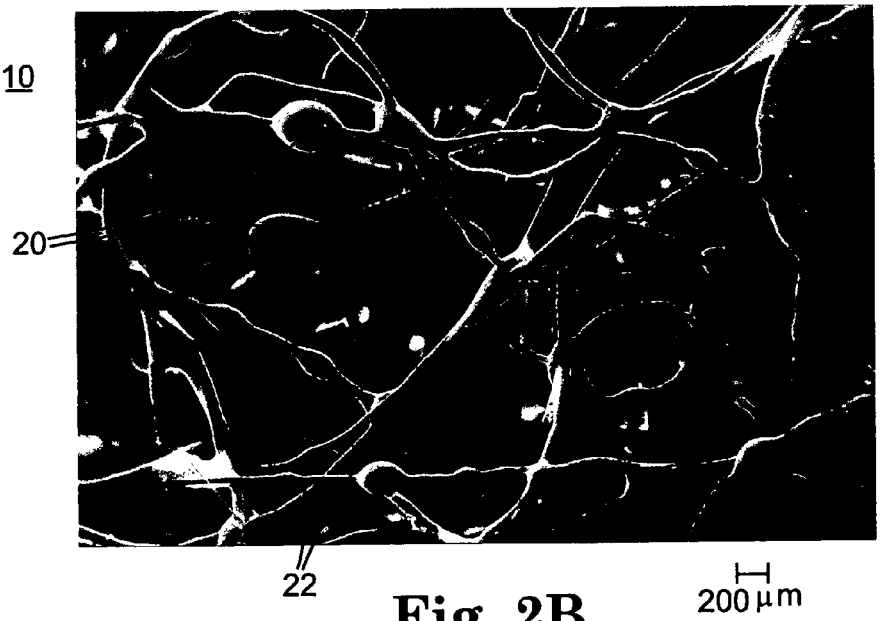
FIG. 2B is a close-up, cross-sectional photograph of an interior of the inventive cleaning wipe in accordance with the present invention.

With the above designations in mind, the tacky material 20 is coated to each of the fibers 22 such that the fiber sections more proximate to the center 24 have a higher level of the tacky material 20 than sections more proximate to the outer surfaces 14 or 16. The term coating "level" is in reference to one or more parameters commonly used in defining a coating material. Thus, the coating "level" can be in reference to a mass, volume, surface area, quantity, and/or thickness. For example, FIG. 2A schematically illustrates in exaggerated form a change in thickness of the tacky material 20 coating relative to an extension of each of the fibers 22. For the first fiber 22*a*, the tacky material 20 coating thickness is greater along the first section 26 as compared to the second section 28. Similarly, relative to the second fiber 22*b*, the second section 32 has a thicker coating of the tacky material 20 as compared to the first and third sections 30, 34. Finally, with respect to the third fiber 22*c*, the second section 38 has a thicker coating of the tacky material 20 as compared to the first and third sections 36, 40. Relative to each of the fibers sections described above, a relatively progressive decrease in the tacky material 20 coating thickness is provided as the fiber section extends from the center 24 toward one of the outer surfaces 14 or 16. Alternatively, a less uniform distribution of the tacky material 20 relative to the fibers 22 can be provided. For example, the tacky material 20 level can be relatively constant in the center 24, drastically decreasing at or near the outer surface 14 and/or 16. Similarly, the tacky material 20 level can differ at opposite sides of the center 24 (i.e., non-symmetrical adhesive level relative to the center 24), but again will be significantly less at or near the outer surface 14 and/or 16. By way of example, FIG. 2B is a close-up, cross-sectional photograph of an exemplary embodiment of the cleaning wipe 10, showing the tacky material 20 (referenced generally in FIG. 2B) on individual fibers 22 (referenced generally in FIG. 2B, it being noted that the fibers 22 in the view of FIG. 2B are coated with the tacky material 20). Notably, the photograph of FIG. 2B is from an interior of the cleaning wipe 10, such that the tacky material gradient of the present invention is not physically shown, nor are the outer surfaces 14, 16 (FIG. 2A).

Returning to FIG. 2A, in addition to describing the varying tacky material level in terms of individual fibers 22, reference can be made to the fiber web 12 as a whole. In this regard, the outer surfaces 14, 16 are in one embodiment generally planar (with void volume not being reflected in the schematic illustration of FIG. 2A), with the so-defined planes being substantially parallel to one another. Successive intermediate planes parallel to the planes of the outer surfaces 14, 16 can also be defined through a thickness of the fiber web 12 within the intermediate area 18. For example, a center plane is defined at the center 24, that is otherwise generally parallel relative to the planes defined by the outer surfaces 14, 16. With these definitions in mind, the varying level of the tacky material 20 coating can be described by the intermediate planes more proximate the center 24 having an elevated volume or mass of the tacky material 20 as compared to sectional planes more proximate either of the outer surfaces 14, 16. For example, the mass or volume per unit area of the tacky material 20 on the center plane is greater than that on the planar segment defined by either of the outer surfaces 14 or 16.

By way of further example, a thickness of the fiber web 12 (as otherwise shown in FIG. 2A) can be hypothetically divided into portions, such as a first portion 50, a second portion 52, and a third portion 54. Each of the portions 50-54 are approximately one-third of the fiber web 12 thickness. The second or middle portion 52 has a greater mass and/or volume of the tacky material 20 as compared to the outer portions 50, 54.

Figure 3A:
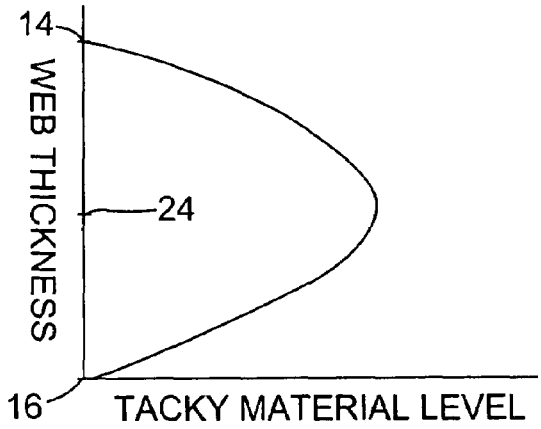
FIGS. 3A-3D are graphs illustrating tacky material gradients associated with embodiments of the cleaning wipe of the present invention.
Figure 3B:
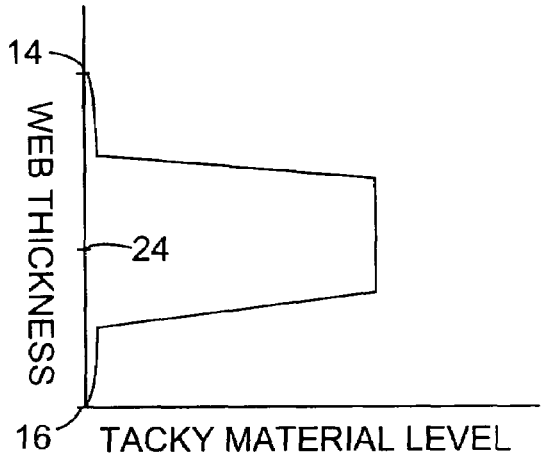
Figure 3C:
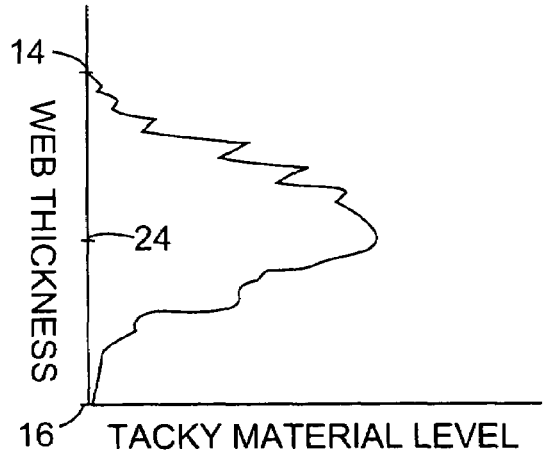
Figure 3D:
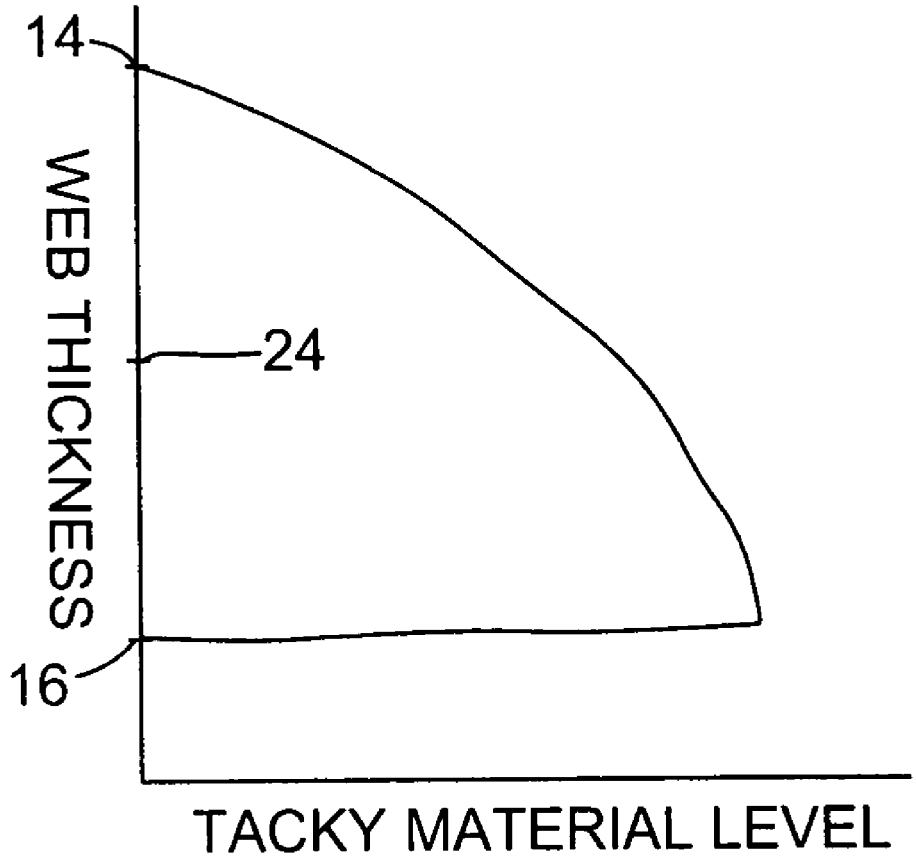

In effect, a tacky material gradient is defined across a thickness of the fiber web 12. As graphically illustrated in FIG. 3A, in one embodiment, the tacky material gradient decreases from the center 24 of the web 12 to the outer surfaces 14, 16. As a point of reference, the Y-axis in FIG. 3A (as well as FIGS. 3B-3D) schematically represents incremental cross-sectional planes of the web 12 from the outer surface 16 to the outer surface 14, and is not intended to reflect specific dimensions. Alternative exemplary tacky material gradients in accordance with the present invention are provided in FIG. 3B (drastic decrease in the tacky material level at the outer surface 14, 16 ); FIG. 3C (generally non-uniform tacky material level); and FIG. 3D (gradual decrease in the tacky material level from the center 24 to the outer surface 14 that otherwise serves as the working surface, and relatively high tacky material level at the outer surface 16 that otherwise serves as the non-working surface and may be covered with a separate film, foil, or paper material).

Returning to FIG. 1, by forming the cleaning wipe 10 such that the outer surfaces 14, 16 are relatively free of the tacky material 20 (FIG. 2A), and providing an elevated level of the tacky material 20 proximate to the center 24 (FIG. 2A), the cleaning wipe 10 satisfies consumer preferences for a non-tacky or non-sticky "feel" and reduced drag during use. In this regard, and during use, the cleaning wipe 10 is held by the user (not shown) at one of the outer surfaces 14 or 16. The opposing outer surface 14 or 16 is then maneuvered in a wiping fashion along a surface (not shown) to be cleaned. The outer surface 14 or 16 otherwise used to clean the surface is defined as the "working surface" of the cleaning wipe 10. Thus, for example, where the user's hand grasps the outer surface 14, the outer surface 16 serves as the working surface, and vice-versa. Because the level of the tacky material 20 is greatly reduced at, and in one embodiment entirely absent from, the outer surfaces 14, 16, a user touching either of the outer surfaces 14 or 16 will not readily discern a sticky or tacky-like feel, and little or no tacky material residue will be deposited on the surface being wiped. Notably, the cleaning wipe 10 can also be used in conjunction with a holding device (not shown) such as a short or long handle, an end of which is adapted to retain the cleaning wipe 10. In conjunction with these applications and/or with independent use of the cleaning wipe 10, a film, foil, or paper layer (not shown) can be applied over the non-working surface 14 or 16.

Similarly, the outer surface 14 or 16 otherwise serving as the working surface during a cleaning operation will exhibit limited drag as the outer surface 14 or 16 is moved across the surface being cleaned. That is to say, due to the reduced level of the tacky material 20 at the outer surface 14 or 16, little or no tacky material 20 is present that might otherwise impart a drag as the cleaning wipe 10 is moved across the surface to be cleaned. As described in greater detail below, an overall level of the tacky material 20 can thus be relatively high (thus enhancing the ability of the cleaning wipe 10 to retain relative large and/or heavy particles), while still maintaining the desired, limited drag characteristic. In one embodiment, an overall level of tacky material (relative to an entirety of the fiber web 12) is in the range of 10-200 g/m$^2$, with at least one of the outer surfaces 14 or 16 having a Drag Value of not more than 5 pounds (the phrase "Drag Value" is defined in detail below). In another embodiment, the overall level of tacky material is greater than 10 g/m$^2$; and in another embodiment, not less than 15 g/m$^2$; and in another embodiment, not less than 20 g/m$^2$. With each tacky material level embodiment, the Drag Value of at least one of the outer surfaces 14 or 16 is not more than 5 pounds; and in another embodiment not more than 2 pounds. Notably, the tacky material level of the present invention is significantly greater than other proposed cleaning wipe constructions adapted to minimize drag and adhesive "feel". For example, U.S. patent Publication No. 2002/00050016 describes a polymeric additive level of not greater than about 10 g/m$^2$ (most preferably no greater than about 2 g/m$^2$). Thus, the cleaning wipe 10 of the present invention will exhibit significantly superior particle retention characteristics, yet fully address the sticky "feel" and drag concerns expressed by users. In one embodiment, this improved Drag Value is accomplished without the use of a detackifying agent; alternatively, however, a detackifying agent can be applied to one or both of the outer surfaces 14, 16.

Figure 4A:
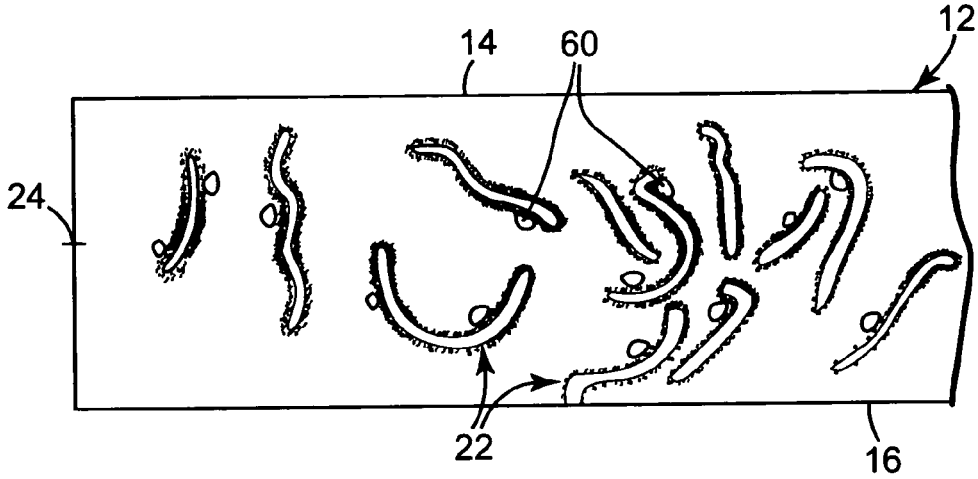
FIG. 4A is an enlarged, cross-sectional view of a portion of the cleaning wipe of FIG. 1 following an exemplary cleaning operation.
Figure 4B:
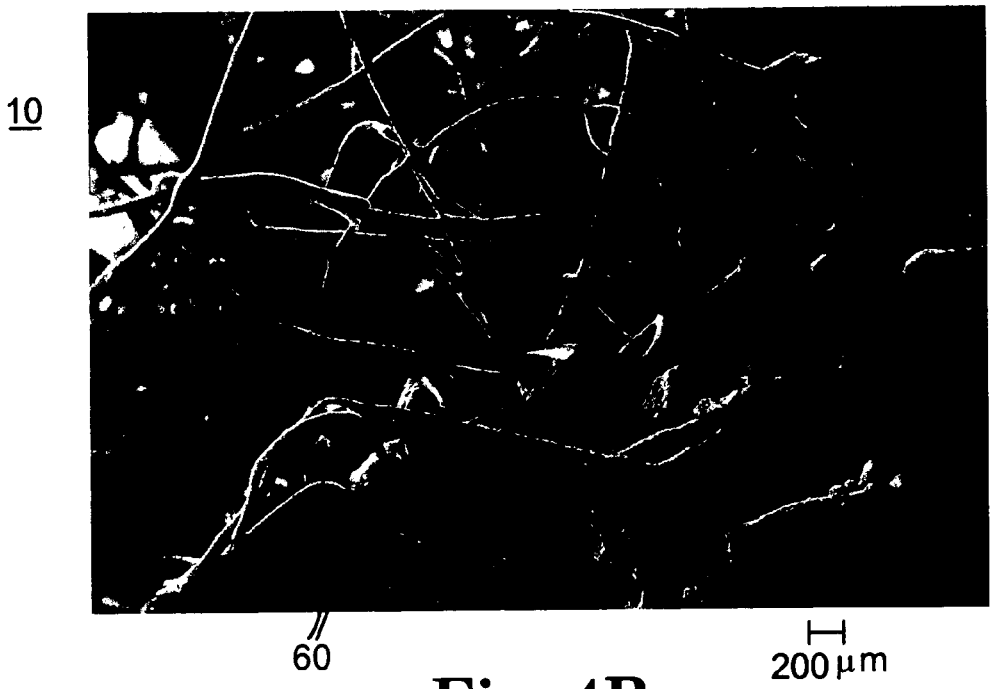
FIG. 4B is a close-up, cross-sectional photograph of an interior of the inventive cleaning wipe in accordance with the present invention following an exemplary cleaning operation.

An additional benefit provided by the cleaning wipe 10 of the present invention relates to an ability to retain not only large and/or heavy particles, but also to retain a large volume of any sized particle. With reference to FIG. 4A, for example, a schematic, cross-section of the cleaning wipe 10 is shown following a cleaning operation (it again being recalled that the outer surfaces 14, 16 are shown in FIG. 4A as being substantially flat for ease of illustration). With the one exemplary embodiment of FIG. 4A, the fiber web 12 provides an open structure (i.e., relatively large spacing between individual fibers 22). With this one exemplary construction, relatively large particles 60 (shown schematically in FIG. 4A) can "nest" between individual fibers 22, as can other, smaller-sized debris (not shown). With the representation of FIG. 4A, the outer surface 14 was used as the working surface, and wiped over a surface to be cleaned (not shown). During the cleaning movement, the particles 60 are interjected between the fibers 22, with the tacky material coating causing the so-contacted particles 60 to partially adhere to one or more of the fibers 22 (as do other, smaller particles). Because the tacky material coating level at the outer surface 14 is greatly reduced as compared to that more proximate to the center 24, the particle 60 will not accumulate along the outer surface 14. Instead, the particle 60 is readily deposited within a thickness of the cleaning wipe 10. Thus, the outer or working surface 14 does not become "clogged" with particles, resulting in an increased number or volume of particles collected by the cleaning wipe 10. The close-up, cross-sectional photograph of FIG. 4B further shows the particles 60 (referenced generally in FIG. 4B) being retained within a thickness of one exemplary embodiment of the cleaning wipe 10.

Within the constraints described above and returning to FIG. 1, the fiber web 12 and the tacky material 20 can assume a variety of forms. The fiber web 12 or individual fiber web layers thereof can be a knitted, woven, or preferably a nonwoven fibrous material. With the one embodiment in which the fiber web 12 is a nonwoven fibrous structure, the fiber web 12 is comprised of individual fibers entangled with one another (and optionally bonded) in a desired fashion. The fibers are preferably synthetic or manufactured, but may include natural fibers. As used herein, the term "fiber" includes fibers of indefinite length (e.g., filaments) and fibers of discrete length (e.g., staple fibers). The fibers used in connection with the fiber web 12 may be multicomponent fibers. The term "multicomponent fiber" refers to a fiber having at least two distinct longitudinally coextensive structured polymer domains in the fiber cross-section as opposed to blends where the domains tend to be dispersed, random, or unstructured. Regardless, useful fiberous materials include, for example, polyester, nylon, polypropylene of any appropriate fiber length and denier, and mixtures thereof. Further, some or all of the fibers can be selected and/or processed to exhibit an electrostatic property. Also, a colorant can be incorporated into the tacky material 20.

Small denier size staple fibers (e.g., 3*d*-15*d*) provide the fiber web 12 with smaller pore sizes and more surface area as compared to a fiber web made with larger denier fibers (e.g., 50*d*-200*d*) that otherwise provides the fiber web 12 with larger pore sizes and less surface area. The small denier fiber webs are best suited for cleaning surfaces contaminated with fine dust and dirt particles, whereas the large denier fiber webs are best suited for cleaning surfaces contaminated with larger dirt particles such as sand, food crumbs, lawn debris, etc. As described above, the larger pore sizes of the larger denier staple fibers allows the larger contaminant particles to enter, and be retained by, the matrix of the fiber web. The fiber web 12 of the present invention can include one or both of the small and/or large denier fibers that may or may not be staple fibers. In one embodiment, the fiber web 12 includes crimped, high heat distortion fibers.

Further, as described in greater detail below, one method of forming the cleaning wipe 10 in accordance with the present invention entails providing two separate fiber web layers that are subsequently joined by a tacky material. With this in mind, the two fiber web layers can have varying constructions and/or attributes described above (e.g., one fiber web layer includes small denier size staple fibers and the second fiber web layer includes large denier size staple fibers; one fiber web layer exhibits normal absorbent capabilities and the second fiber web layer is super absorbent; etc.).

In addition to the availability of a wide variety of different types of fibers useful for the one embodiment nonwoven fiber web 12, the technique for bonding the fibers to one another is also extensive. In general terms, suitable processes for making the one embodiment nonwoven fiber web 12 that may be used in connection with the present invention include, but are not limited to, carding, air laying, wet laying, spun bonding, etc. Bonding methods include, but are not limited to, thermal bonding, resin bonding, calendar bonding, ultrasonic bonding, etc.

The tacky material 20 of the cleaning wipe 10 can assume a variety of forms, with the particular properties being dependent on the use of the cleaning wipe. In one embodiment, the tacky material 20 includes a pressure sensitive adhesive. Pressure sensitive adhesives are normally tacky at room temperature and can be adhered to a variety of surfaces by application of light finger pressure. An adhesive bond is developed by pressing a second surface (or individual particles of a second material such as, e.g., dust, dirt, crumbs, or other debris) against the pressure sensitive adhesive coated material. A general description of useful pressure sensitive adhesive compositions can be found in the Encyclopedia of Polymer Science and Engineering, vol. 13, Wiley-Interscience Publishers (New York, 1988). Additional descriptions of pressure-sensitive adhesive compositions can be found in Encyclopedia of Polymer Science and Technology, vol. 1, Interscience Publishers (New York, 1964).

The pressure sensitive adhesive composition can include, e.g., elastomeric block copolymers, natural rubber, butyl rubber and polyisobutylene, styrene-butadiene rubber (SBR), polyisoprene, polyalphaolefins, and polyacrylates. Examples of useful thermoplastic elastomeric block copolymers include styrene-isoprene (SI), styrene-isoprene-styrene (SIS), styrene-butadiene-styrene (SBS), ethylene-propylene-diene, styrene-ethylene/butylene-styrene (SEBS), and styrene-ethylene/propylene-styrene (SEPS). Other useful adhesive compositions may include, e.g., polyvinyl ethers, ethylene containing copolymers such as, e.g., ethylene vinyl acetate, ethylacrylate, and ethyl methacrylate, polyurethanes, polyamides, polyepoxides, polyvinylpyrrolidones and copolymers thereof, polyvinylalcohols and copolymers thereof, polyesters, and combinations thereof.

Preferred elastomeric block copolymer-based pressure sensitive adhesive compositions include block copolymers such as, e.g., styrene-isoprene-styrene (SIS) and styrene-ethylene/butylenes-styrene (SEBS). Representative examples of commercially available elastomeric block copolymers suitable for the adhesive composition of the tacky material 20 include the styrene-isoprene-styrene elastomer "Kraton 1107" and the styrene-ethylene/butylene-styrene elastomer "Kraton 1657", both available from Kraton Polymers, Houston, Tex.

The elastomeric block copolymers of the adhesive composition may be formulated with tackifying resins (tackifiers) to improve adhesion and introduce tack into the pressure sensitive adhesive useful in one embodiment as the tacky material 20. Suitable tackifier resins are described in D. Satas, Handbook of Pressure-Sensitive Adhesive Technology, pp. 527-544, (2nd ed. 1989).

Suitable tackifying resins include, e.g., rosin esters, terpenes, phenols, and aliphatic, aromatic, or mixtures of aliphatic and aromatic synthetic hydrocarbon monomer resins. The tackifier components useful in block copolymer adhesive compositions can be solid, liquid, or a blend thereof. Suitable solid tackifiers include rosin, rosin derivatives, hydrocarbon resins, polyterpenes, coumarone indenes, and combinations thereof. Suitable liquid tackifiers include liquid hydrocarbon resins, hydrogenated liquid polystyrene resins, liquid polyterpenes, liquid rosin esters, and combinations thereof. Many tackifiers are commercially available, and optimum selection thereof can be accomplished by one of ordinary skill in the adhesive compounding art.

Suitable adhesive compositions include, e.g., hot melt coatable, transfer-coatable, solvent-coatable; and latex adhesive compositions. More particularly, and in one embodiment, the tacky material 20 is a hot melt coatable pressure sensitive adhesive. Suitable hot melt coatable pressure sensitive adhesives include HL-1902 and HL-2168, available from H. B. Fuller Company, St. Paul, Minn.

Further, the tacky material 20 can include a polymeric additive such as tacky polymers alone or in combination with one or more pressure sensitive adhesives, as described above. Suitable tacky polymers include, but are not limited to, N-decylmethacrylate polymer, polyisobutylene polymers, alkyl methacrylate polymers, polyisobutylene polymers, polyalkyl acrylates, and mixtures thereof.

The tacky material 20 composition can also include additives such as, e.g., plasticizers, diluents, fillers, antioxidants, stabilizers, pigments, cross-linking agents, and the like.

Figure 5:
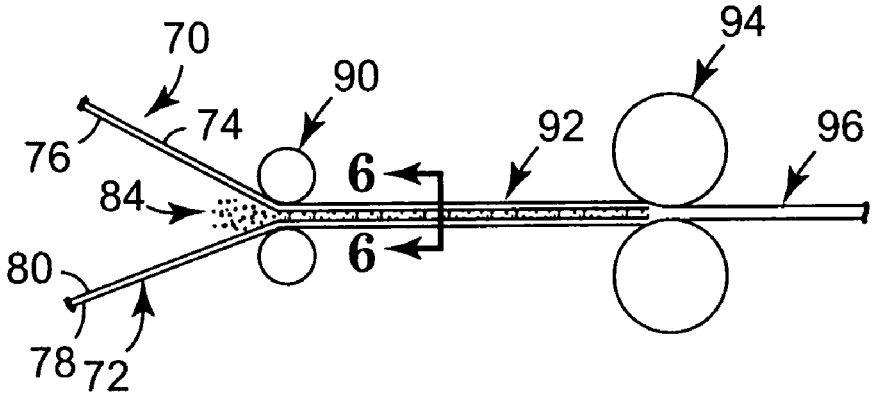
FIG. 5 is a diagrammatic illustration of a method of forming a cleaning wipe in accordance with the present invention.

With the above materials in mind, one method of manufacturing the cleaning wipe 10 in accordance with the present invention is illustrated diagrammatically in FIG. 5. First and second fiber web layers 70, 72 are initially provided, with the first fiber web layer 70 defining first and second opposing outer surfaces 74, 76 and the second fiber web layer 72 defining first and second opposing outer surfaces 78, 80. The fiber web layers 70, 72 can be identical, or can have varying constructions and/or performance attributes as previously described. Regardless, a tacky material 84 (exaggerated in the view of FIG. 5) is applied to the second outer surface 76 or 80 of at least one of the fiber web layers 70 or 72. In one embodiment, the tacky material 84 is applied to the second outer surface 76 and 80 of both of the fiber web layers 70 and 72, as shown in FIG. 5. For example, the tacky material 84 can be sprayed between the fiber web layers 70, 72, and thus applied to the second outer surface 76, 80 of each of the fiber web layers 70, 72.

Alternatively, a transfer coated adhesive can be used to apply the tacky material 84 to one or both of the fiber web layers 70 and/or 72. For example, a single or double coated tape (not shown) can be first adhered to the first fiber web layer 70, and the release liner and/or backing (not shown) removed to facilitate adhering of the second fiber web layer 72. In another embodiment, a first type of the tacky material 84 is applied to the first fiber web layer 70 and a second type of the tacky material 84 is applied to the second fiber web layer 72. With this approach, differing characteristics of the first and second tacky materials (e.g., tackiness) can cause opposing sides of the resultant cleaning wipe (described below) to perform differently during use. Regardless, the fiber web layers 70, 72 are brought together along the tacky material-laden surface(s) (e.g., the surfaces 76, 80), such as with a low-pressure compression device 90, to define a web construction 92. The low-pressure compression device 90 can assume a variety of forms, such as a pair of rollers positioned to apply a relatively small compressive force onto the fiber web layers 70, 72 (e.g., approximately 5 PLI). Alternatively, the low-pressure compression device 90 can be eliminated, as described below.

Figure 6:
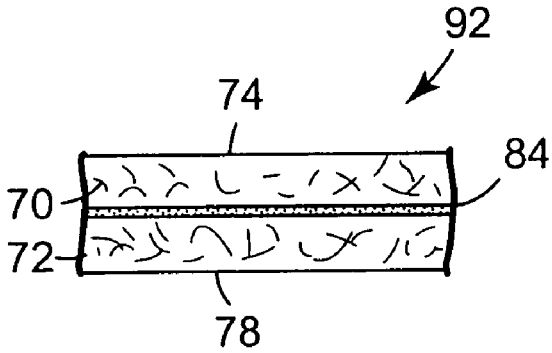
FIG. 6 is a cross-sectional view of a cleaning wipe construction during an initial stage of the manufacturing technique of FIG. 5, as seen along the line 6-6 of FIG. 5.

As shown in FIG. 6, with the one technique of FIG. 5, the web construction 92 is defined by three layers, including the fiber web layers 70, 72 and the tacky material 84. The exposed first outer surface 74 of the first fiber web layer 70 and the exposed first outer surface 78 of the second fiber web layer 72 define opposing faces of the web construction 92. Alternatively, a single fiber web can be provided that, following application of the tacky material 84, is folded on to itself, resulting in the web construction.

Returning to FIG. 5, the web construction 92 is then processed by a high-pressure compression device 94 that places a transverse compression force on to the web construction 92. In one embodiment, the compression device 94 is a calender forming a nip through which the web construction 92 is fed, and adapted to impart a relatively high compressive force (e.g., on the order of 100 PLI). Alternatively, other compression devices can be employed, such as a two-bar or belt restricting device, etc. Even further, the web construction 92 can be manually compressed. Regardless, the compression device 94 forces the tacky material 84 to flow outwardly, toward the exposed outer surfaces 74, 78 (FIG. 6). In one embodiment, the compression device 94 is adapted to heat the web construction 92 in addition to imparting the compressive force, with the heat causing the tacky material 84 (especially a hot melt pressure sensitive adhesive) to soften and thus more readily flow within each of the fiber web layers 70, 72 (i.e., around the various fibers comprising each fiber web layer 70, 72).

Following processing by the compression device 94, the tacky material 84 bonds the fiber web layers 70, 72 to one another, resulting in a cleaning wipe web 96. Further, the tacky material 84 coats at least portions of the individual fibers within each of the fiber web layers 70, 72. In particular, because the tacky material 84 has flowed from the inside of the cleaning wipe web 96 toward the first outer surfaces 74, 78, a varying tacky material coating level is achieved relative to each of the fibers as well as to the cleaning wipe 96 web as a whole. In one embodiment, as the fiber web layers 70, 72 exit the compression device 94, they remain compressed due to the tacky material 84 tightly bonding the fibers (unnumbered) to one another. Where desired, the cleaning wipe web 96 can be relofted (e.g., subjecting the cleaning wipe web 96 to heat) following processing by the compression device 94, to regain the open, lofty structure of the fiber web layers 70, 72. Alternatively, a construction of the fiber web layers 70, 72 can allow relofting or re-bulking to occur spontaneously under the appropriate operating conditions of the compression device 94. Further, the cleaning wipe web 96 can be subjected to a forming or embossing process to create additional openings at the cleaning wipe web 96 surface(s) and/or to generate a desired aesthetic appearance.

Figure 7:
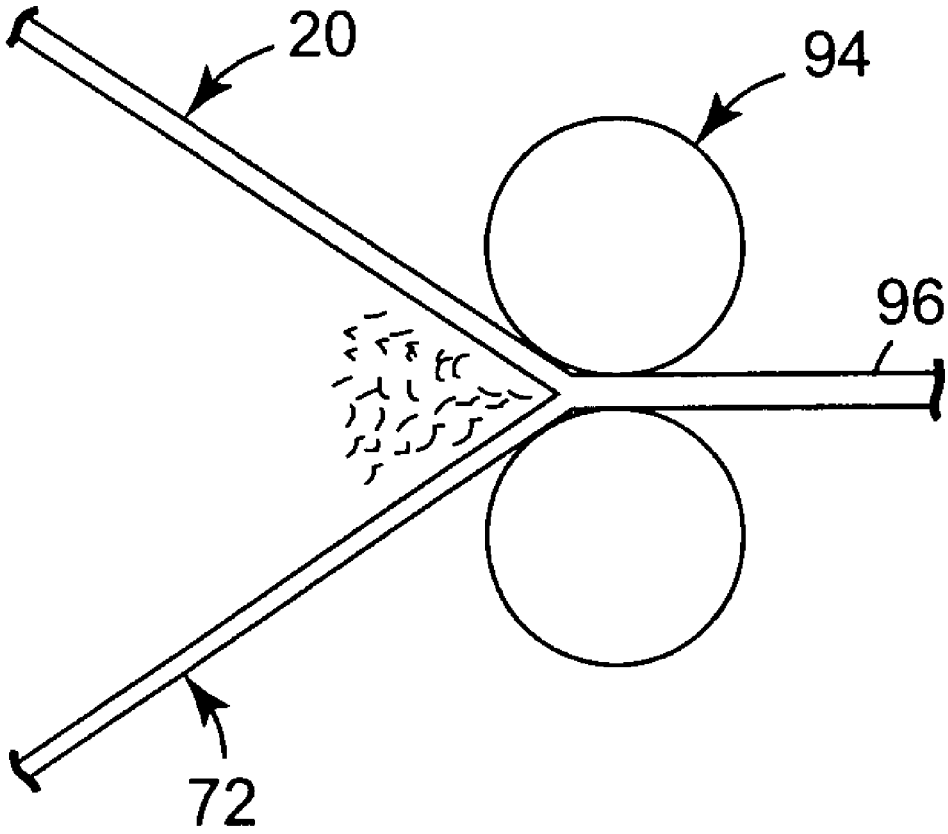
FIG. 7 is a diagrammatic illustration of an alternative method of forming a cleaning wipe in accordance with the present invention.
Figure 8:
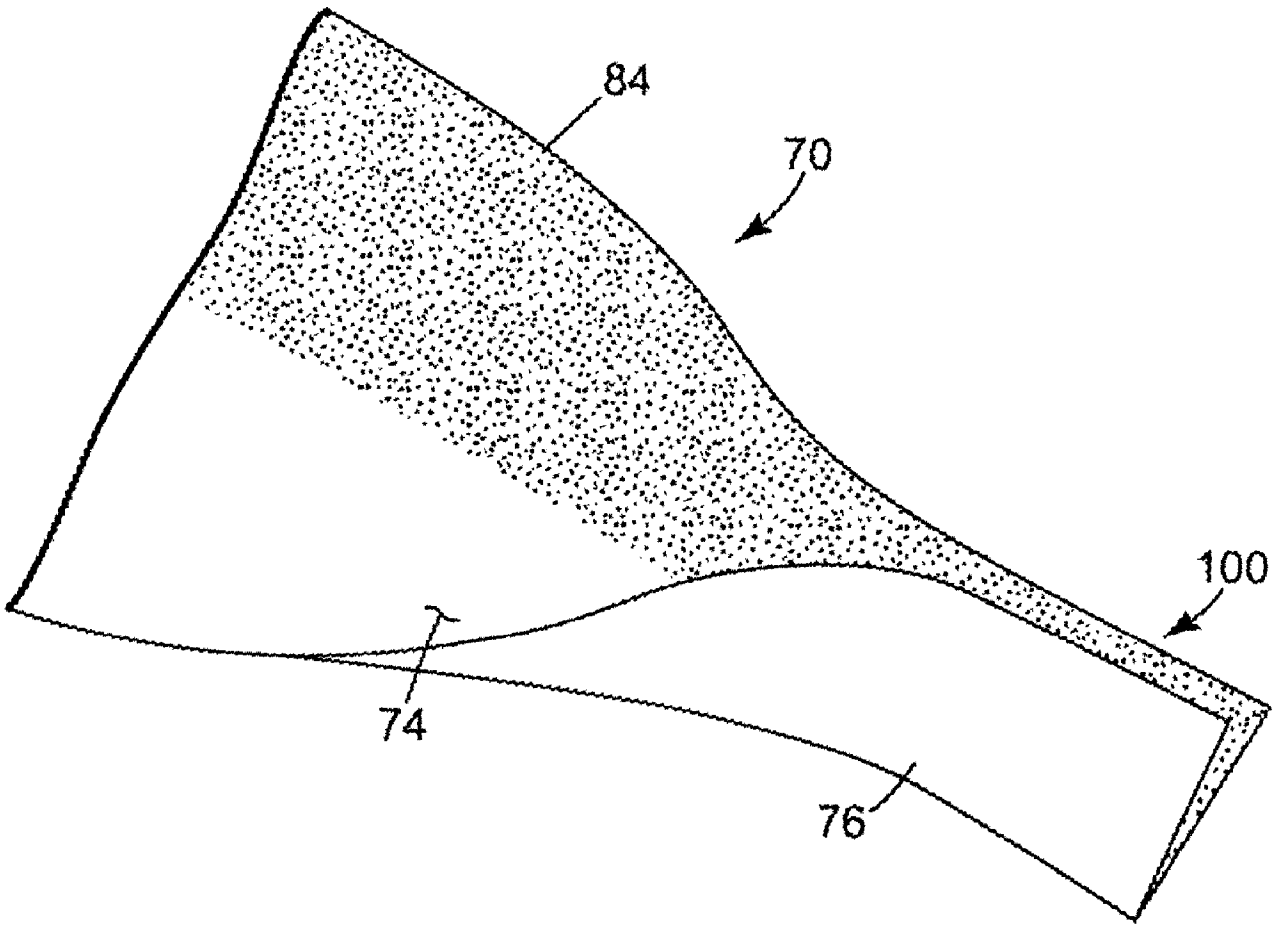
FIG. 8 is a perspective view of a web of material being processed in accordance with another alternative method of forming a cleaning wipe in accordance with the present invention.

The method of manufacture associated with FIG. 5 is but one acceptable embodiment for forming the cleaning wipe 10 (FIG. 1) in accordance with the present invention. For example, as shown in FIG. 7, the tacky material 84 can be applied immediately prior to, or simultaneously with, processing by the high-pressure compression device 94. Similarly, the web construction 92 can be wrapped about a calendering device as part of the high-pressure application operation. Alternatively, and as shown in FIG. 8, a single fiber web, such as the first fiber web 70, can initially be provided as a continuous material sheet. The tacky material 84 is applied to one of the outer surfaces 74 or 76 (FIG. 8 depicts the tacky material 84 being applied to the first outer surface 74). To this end, the tacky material 84 can be applied to an entirety of the selected outer surface 74 or 76, or to only a portion thereof. Regardless, the fiber web 70 is folded onto itself (either down web or cross web) so as to define first and second fiber web layers; more particularly, the outer surface 74 or 76 to which the tacky material 84 was applied (e.g., the first outer surface 74 with the illustration of FIG. 8) is folded onto itself. The resulting web construction 100 is then processed by the high-pressure compression device 94 (FIG. 5), producing the cleaning wipe web as previously described.

With any of the above-described methods, by varying one or more of the tacky material type and/or basis weight, fiber denier and/or basis weight, compression force, temperature, line speed, etc., the resultant cleaning wipe can be formed to provide certain desired characteristics. Further, multiple ones of the so-formed cleaning wipe webs 96 can be releasably secured to one another in a back-to-back fashion (such as by an appropriate adhesive or other tacky material). With this configuration, individual cleaning wipes can be successively stripped from the multiple layer assembly before, during, or after use in cleaning.

The following examples and comparative examples further describe the cleaning wipes of the invention, methods of forming the cleaning wipes, and the tests per formed to determine the various characteristics of the cleaning wipes. The examples are provided for exemplary purposes to facilitate an understanding of the invention, and should not be construed to limit the invention to the examples.

EXAMPLES

Test Methods

Sand Removal Test A

Sand removal was measured by distributing two grams (designated as $W_1$) of sand (less than or equal to 200 μm mean diameter) on the surface of a 60 cm×243 cm vinyl floor. A sample of the cleaning wipe was attached to the head (cleaning wipe facing away from the head) of a ScotchBrite™ High Performance Sweeper mop (available from 3M Company, St. Paul, Minn.). The sweeper head with the cleaning wipe attached was weighed and recorded as $W_2$. The sweeper head was attached to the sweeper stick and the test sample was pushed once over the entire flooring area (i.e., one pass over every area of the flooring that had sand on it) with minimal pressure applied to the handle of the sweeper mop. The head was again removed from the stick and its weight was measured (designated as $W_3$). The weight percent of the sand removed by the cleaning wipe test sample from the surface was calculated as follows:

$$\%\ \text{Sand Removed}=[(W_3-W_2)/W_1]\times 100$$

Sand Removal Test B

Sand removal was measured according to Sand Removal Test A except that sand having a larger mean diameter of 700-1000 μm was used for testing.

Rice Flake Removal Test C

Rice flake removal was measured according to Sand Removal Test A except dry rice flakes were used for testing.

For all of the sand and rice flake removal tests, the data reported are an average at least two tests.

Drag Measurement and Drag Value

A Model 100 Force Gauge (available from Chatillon Ametek Company, Brooklyn, N.Y.) was attached to a standard ScotchBrite™ High Performance Sweeper mop (available from 3M Company, St. Paul, Minn.). The Model 100 Force Gauge was mounted onto the 3M mop and handle by means of a fixturing device. The fixturing device was made to attach the mop handle with standard machine screws, and was mounted in such a way that the force required to push the mop along a test floor could be recorded. The test floor surface was a 60 cm×243 cm piece of vinyl flooring material. The test floor was cleaned with a standard broom and dusted with a Dooddleduster™ cloth (available from 3M Company, St. Paul, Minn.) between each test. A 12.7 cm×35.6 cm sample of cleaning wipe material was cut and mounted onto the test mop head having a length of 13.5 inches (35 cm) and a width of 3.75 inches (9.5 cm). The mop was then pushed along the floor. To this end, the mop head was constructed such that the handle could swivel relative to the mop head. During pushing, an angle of the handle relative to a plane of the mop head (and thus of the test floor) was maintained at less than 80°. The maximum force (in pounds) to the push the mop was recorded on the Chatillon Model 100 Force Gauge. The maximum force so-recorded is designated as the Drag Value of the cleaning wipe test sample. The data reported are an average of at least two tests.

Glossary

Fiber Materials

Fiber materials used in the examples are described in Table 1.

TABLE 1

| Fiber Type | Description | Manufacturer |
|---|---|---|
| Kosa 293 | 32 denier, polyester, 1.5 inch cut length | KoSa, Nonwovens & Specialty Polyester Fibers, Charlotte, NC |
| Wellstrand 944P | 100 denier, polyester, 2.5 inch cut length | Wellman Inc., Fibers Division, Charlotte, NC |
| Celbond 254 | 12 denier, polyester core/copolyester sheath, 1.5 inch cut length | KoSa, Nonwovens & Specialty Polyester Fibers, Charlotte, NC |

Tacky Materials

Tacky materials used in the examples are described in Table 2.

TABLE 2

| Tacky Material Type | Description | Manufacturer |
|---|---|---|
| H5007-01 | Hot melt pressure sensitive adhesive | Bostik Findley Inc., Wauwatosa, WI |
| HL-1902 | A styrene-isoprene-styrene (SIS)-type block copolymer-based, hot melt pressure sensitive adhesive | HB Fuller Company, St. Paul, MN |
| HL-2168 | A styrene-ethylene-butylene-styrene (SEBS)-type block copolymer based; hot melt pressure sensitive adhesive | HB Fuller Company, St. Paul, MN |

Example 1

An airlaid nonwoven web was prepared from 32 denier polyester staple fibers and 12 denier bicomponent melty fibers using a Rando-Webber airlaid machine (Model 12-BS, available from Curlator Corp., East Rochester, N.Y.). The weight ratio of the 32-denier fibers to the 12 denier fibers was approximately 4:1. The basis weight of the web was approximately 40 g/m$^2$.

The web was then transported from the Rando-Webber into a 12-foot long oven using a conveyor belt. The oven had both top and bottom air impingement and was set at a temperature of 350° F. and a line speed of 20 feet per minute, that melted the sheath of the 12 denier bicomponent melty fibers to produce a coherent staple fiber web. The web was then wound into roll form. Two of these webs were then laminated to each other using a hot melt, pressure sensitive adhesive (Type HL-1902, available from H. B. Fuller Company, St. Paul, Minn.). The adhesive was fed using a 4-inch single screw extruder (available from Bonnot Company, Uniontown, Ohio) to a gear pump that controlled the flow of the adhesive into an adhesive meltblowing die. The molten adhesive fibers were blown onto one of the nonwoven webs, which was then laminated to a second, identical web using an unheated laminator nip with a nip force of approximately 7 pli. The adhesive coating width was approximately 10 inches wide. The extruder and meltblowing die were set at temperatures of 165° C. The fiber attenuation air was set at about 155° C. The adhesive flow rate was approximately 6.0 pounds per hour and the laminator line speed was approximately 26 feet per minute, resulting in an adhesive coating weight of approximately 23 grams/m$^2$.

The laminated web was then placed between two silicone coated paper liners and passed through a heated calendering nip. The calender consisted of two, 10-inch diameter, steel rolls. The surface temperature of the rolls was 280° F., the line speed was 5 feet per minute, and the nip pressure was about 95 pli. This caused the adhesive to soften and flow outwardly toward the exposed surfaces of the nonwoven webs. At this point, the laminated web was very compressed. Removing the silicone paper liners and heating it in an oven at 180° C. for approximately 30 seconds then relofted this compressed web. The thickness of the relofted web was approximately 0.25 inch (6.3 mm).

Example 2

An airlaid nonwoven web was prepared from 100 denier polyester staple fibers and 12 denier bicomponent melty fibers using a Rando-Webber airlaid machine (Model 12-BS, available from Curlator Corp., East Rochester, N.Y.). The weight ratio of the 100-denier fibers to the 12-denier fibers was approximately 4:1. The basis weight of the web was approximately 70 g/m$^2$.

The web was then transported from the Rando-Webber into a 12-foot long oven using a conveyor belt. The oven had both top and bottom air impingement and was set at a temperature of 350° F. and a line speed of 20 feet per minute, that melted the sheath of the 12 denier bicomponent melty fibers to produce a coherent staple fiber web. The web was then wound into roll form. Two of these webs were then laminated to each other using a hot melt, pressure sensitive adhesive (Type H5007-01, available from Bostik Findley, Wauwatosa, Wis.). The adhesive was fed using a 4-inch single screw extruder (available from Bonnot Company, Uniontown, Ohio) to a gear pump that controlled the flow of the adhesive into an adhesive meltblowing die. The molten adhesive fibers were blown onto one of the nonwoven webs, which was then laminated to a second, identical web using an unheated laminator nip with a nip force of approximately 7 pli. The adhesive coating width was approximately 10 inches wide. The extruder and meltblowing die were set at temperatures of 165° C. The fiber attenuation air was set at about 155° C. The adhesive flow rate was approximately 6.0 pounds per hour and the laminator line speed was approximately 12 feet per minute, resulting in an adhesive coating weight of approximately 50 g/m$^2$.

The laminated web was then placed between two silicone coated paper liners and passed through a heated calendering nip. The calender consisted of two, 10-inch diameter, steel rolls. The surface temperature of the rolls was 280° F., the line speed was 5 feet minute, and the nip pressure was about 95 pli. This caused the adhesive to soften and flow outwardly toward the exposed surfaces of the nonwoven webs. At this point, the laminated web was very compressed. Removing the silicone paper liners and heating it in an oven at 180° C. for approximately 30 seconds then relofted this compressed web. The thickness of the relofted web was approximately 0.25 inch (6.3 mm).

Example 3

A carded nonwoven web was prepared from 32 denier polyester staple fibers and 12 denier bicomponent melty fibers using a carding machine (Model M.C., available from Hergeth Hollingsworth, West Germany). The weight ratio of the 32-denier fibers to the 12-denier fibers was approximately 4:1. The basis weight of the web was approximately 65 g/m$^2$.

The web was then transported from the card machine into a 12-foot long oven using a conveyor belt. The oven had both top and bottom air impingement and was set at a temperature of 350° F. and a line speed of 20 feet per minute, that melted the sheath of the 12 denier bicomponent melty fibers to produce a coherent staple fiber web. The web was then wound into roll form. Two of these webs were then laminated to each other using a hot melt, pressure sensitive adhesive (Type HL-2168, available from H.B. Fuller Company, St. Paul, Minn.). The adhesive was fed using a 4-inch single screw extruder (available from Bonnot Company, Uniontown, Ohio) to a gear pump that controlled the flow of the adhesive into an adhesive meltblowing die. The molten adhesive fibers were blown onto one of the nonwoven webs, which was then laminated to a second, identical web using an unheated laminator nip with a nip force of approximately 7 pli. The adhesive coating width was approximately 10 inchs wide. The extruder and meltblowing die were set at temperatures of 165° C. The fiber attenuation air was set at about 155° C. The adhesive flow rate was approximately 6.0 pounds per hour and the laminator line speed was approximately 8 feet per minute resulting in an adhesive coating weight of approximately 75 g/m$^2$.

The laminated web was then placed between two silicone coated paper liners and passed through a heated calendering nip. The calender consisted of two, 10-inch diameter, steel rolls. The surface temperature of the rolls was 280° F., the line speed was 5 feet per minute, and the nip pressure was about 95 pli. This caused the adhesive to soften and flow outwardly toward the surfaces of the nonwoven webs. At this point the laminated web was very compressed. Removing the silicone paper liners and heating it in an oven at 180° C. for approximately 30 seconds then relofted this compressed web. The thickness of the relofted web was approximately 0.36 inch (9.1 mm).

Example 4

An airlaid nonwoven web was prepared from 32 denier polyester staple fibers and 12 denier bicomponent melty fibers using a Rando-Webber airlaid machine (Model 12-BS, available from Curlator Corp., East Rochester, N.Y.). The weight ratio of the 32-denier fibers to the 12-denier fibers was approximately 4:1. The basis weight of the web was approximately 65 g/m$^2$.

The web was then transported from the Rando-Webber into a 12-foot long oven using a conveyor belt. The oven had both top and bottom air impingement and was set at a temperature of 350° F. and a line speed of 20 feet per minute, that melted the sheath of the 12 denier bicomponent melty fibers to produce a coherent staple fiber web. The web was then wound into roll form. Two of these webs were then laminated to each other using a hot melt, pressure sensitive adhesive (Type HL-1902, available from H.B. Fuller Company, St. Paul, Minn.). A fluorescent dye was blended into this adhesive (0.075 weight % based on the original quantity of the HL-1902 adhesive). The adhesive was fed using a 4-inch single screw extruder (available from Bonnot Company, Uniontown, Ohio) to a gear pump that controlled the flow of the adhesive into an adhesive meltblowing die. The molten adhesive fibers were blown onto one of the nonwoven webs, which was then laminated to a second, identical web using an unheated laminator nip with a nip force of approximately 7 lb/in. The adhesive coating width was approximately 10 inches wide. The extruder and meltblowing die were set at temperatures of 165° C. The fiber attenuation air was set at about 155° C. The adhesive flow rate was approximately 6.0 pounds per hour and the laminator line speed was approximately 16 feet per minute resulting in an adhesive coating weight of approximately 38 g/m$^2$.

The laminated web was then placed between two silicone coated paper liners and passed through a heated calendering nip. The calender consisted of two, 10-inch diameter, steel rolls. The surface temperature of the rolls was 280° F., the line speed was 5 feet per minute, and the nip pressure was about 95 pli. This caused the adhesive to soften and flow outwardly toward the surfaces of the nonwoven webs. At this point the laminated web was very compressed. Removing the silicone paper liners and heating it in an oven at 180° C. for approximately 30 seconds then relofted this compressed web. The thickness of the relofted web was approximately 0.31 inch (7.9 mm).

The blending of the fluorescent dye into the adhesive allowed the use of fluorescence imaging techniques to examine the adhesive gradient in a sample of the web. A section of the web was removed to view one of the edges. The sample was mounted on a glass microscope slide and was examined using a Confocal Macroscope (Biomedical Photometrics Inc., Waterloo, Ontario, Canada) imaging an approximate 2 cm×2 cm area. Confocal brightfield (CRB) and confocal fluorescence (CFL) x,y images of the edge were obtained with the sample oriented in the y-direction in the image. The average line profile across the sample was obtained. The CFL line profile indicated the density of the fluorescent dye across the sample. The CRB line profile indicated the width of the sample. The CFL line profile was plotted for the sample, with the sample edge positions marked the sample. The CFL line profile indicated the density of the fluorescent dye was greater in the center of the web sample than at the outer surfaces of the web sample. This would correlate with there being a greater amount of adhesive present in the center of the web than at the outer surfaces of the web.

Example 5

A carded nonwoven web was prepared from 32 denier polyester staple fibers and 12 denier bicomponent melty fibers using a carding machine (Model M.C., available from Hergeth Hollingsworth, West Germany). The weight ratio of the 32-denier fibers to the 12-denier fibers was approximately 4:1. The basis weight of the web was approximately 65 g/m$^2$.

The web was then transported from the card machine into a 12-foot long oven using a conveyor belt. The oven had both top and bottom air impingement and was set at a temperature of 350° F. and a line speed of 20 feet per minute, that melted the sheath of the 12 denier bicomponent melty fibers to produce a coherent staple fiber web. The web was then wound into roll form. This web was then laminated to a 0.71 g/m$^2$, polyester film using a hot melt, pressure sensitive adhesive (Type HL-1902, available from H.B. Fuller Company, St. Paul, Minn.). The adhesive was fed using a 4-inch single screw extruder (available from Bonnot Company, Uniontown, Ohio) to a gear pump that controlled the flow of the adhesive into an adhesive meltblowing die. The molten adhesive fibers were blown onto the polyester film, which was then laminated to the carded, nonwoven web using an unheated laminator nip with a nip force of approximately 7 pli. The adhesive coating width was approximately 10 inches wide. The extruder and meltblowing die were set at temperatures of 165° C. The fiber attenuation air was set at about 155° C. The adhesive flow rate was approximately 6.0 pounds per hour and the laminator line speed was approximately 33 feet per minute resulting in an adhesive coating weight of approximately 18 g/m$^2$.

The nonwoven face of the laminated web was then placed on a silicone coated paper liner and passed through a heated calendering nip. The calender consisted of two, 10-inch diameter, steel rolls. The surface temperature of the rolls was 280° F., the line speed was 5 feet per minute, and the nip pressure was about 95 pli. This caused the adhesive to soften and flow outwardly toward the surface of the nonwoven web. At this point the laminated web was very compressed. Removing the silicone paper liner from the nonwoven surface and heating it in an oven at 180° C. for approximately 30 seconds then relofted this compressed web. The thickness of the relofted web was approximately 0.085 inch (2.2 mm).

Examples 1-5 were each evaluated using the Sand and Rice Flake Removal Test Methods and the Drag Measurement Test Method described above. Results are given in Table 3.

TABLE 3

| Example | Sand Removal Test A | Sand Removal Test B | Rice Flake Removal Test C | Drag Value (pounds) |
|---|---|---|---|---|
| Example 1 | 96 | 89 | 87 | 1.8 |
| Example 2 | 79 | 75 | 72 | 1.5 |
| Example 3 | 51 | 66 | 67 | 1.9 |
| Example 4 | 98 | 94 | 89 | 1.8 |
| Example 5 | 91 | 71.5 | 48 | 2.25 |

By way of comparison, tack cloth samples available from 3M Company, St. Paul, Minn. under the trade name "3M 07910" were subjected to the Drag Measurement test described above. It was essentially impossible to move the mop, so that no readings could be taken from the Chatillon Model 100 Force Gauge (meaning that the tack cloth samples had a Drag Value well in excess of at least 10 pounds).

Although the present invention has been described with reference to preferred embodiments, workers skilled in the art will recognize that changes can be made in form and detail without departing from the spirit and scope of the present invention.

What is claimed is:

1. A cleaning wipe comprising:

a fiber web defining opposing faces and an intermediate region between the opposing faces, wherein at least one of the opposing faces serves as a working surface for the cleaning wipe; and a tacky material impregnated into the fiber web such that the tacky material is present at the working surface and a level of the tacky material is greater in the intermediate region than at the working surface, wherein an amount of tacky material per area of fiber web material is greater in the intermediate region than at the working surface.

2. The cleaning wipe of claim 1, wherein the fiber web defines a central plane mid-way between, and parallel to, planes defined by the opposing faces, and further wherein a ratio of tacky material:web material is greater in the central plane than at the working surface.

3. The cleaning wipe of claim 1, wherein the fiber web defines a central region mid-way between the opposing faces and includes at least one fiber defining first and second sections and positioned such that the first section is proximate the central region and the second section is proximate the working surface, and further wherein a coating thickness of the tacky material at the first section is greater than a coating thickness of the tacky material at the second section.

4. The cleaning wipe of claim 1, wherein the fiber web defines a central region mid-way between the opposing faces and includes a plurality of randomly distributed fibers each defined by a first section that is more proximate the central region and less proximate the working face, and a second section that is more proximate the working face and less proximate the central region, and further wherein each of the fibers are coated with the tacky material such that a coated volume of the tacky material at the first section of each fiber is greater than a coated volume at the second section.

* * * * *